US005787701A

United States Patent [19]

Small

[11] Patent Number: 5,787,701

[45] Date of Patent: Aug. 4, 1998

[54] DISASSEMBLING DEVICE FOR ROLLER CHAINS

[75] Inventor: Frank A. Small, West Springfield, Mass.

[73] Assignee: Patton Tool Co., Inc., West Springfield, Mass.

[21] Appl. No.: 995,528

[22] Filed: Dec. 22, 1997

[51] Int. Cl.[6] ..... B21L 21/00

[52] U.S. Cl. ..... 59/7; 59/11; 29/252

[58] Field of Search ..... 59/7, 8, 35.1, 11; 29/252

[56] References Cited

U.S. PATENT DOCUMENTS 3,553,960 1/1971 Ellefson ..... 59/7

4,506,501 3/1985 Devall et al. ..... 59/7

4,621,491 11/1986 Moriki et al. ..... 59/7

4,881,365 11/1989 Moriki et al. ..... 59/7

5,463,862 11/1995 Reisenauer ..... 59/7

*Primary Examiner*—David Jones

*Attorney, Agent, or Firm*—Ross, Ross & Flavin

[57] ABSTRACT

The invention hereof provides, in a single device, means for accepting and breaking chains of different sizes, from small chains to large, industrial type chains, the device accepting a plurality of drive blocks with outwardly projecting parallel ejection pins of differing sizes and/or spacings to accommodate to chains of different sizes, and accepting a plurality of chain nests of different sizes to receive the pins of a cooperant drive block while holding the chains of a cooperant size thereby permitting the ejection of the roller pins from the chain whereby the chain is "broken" or disassembled.

4 Claims, 3 Drawing Sheets

DISASSEMBLING DEVICE FOR ROLLER CHAINS

BACKGROUND OF THE INVENTION

FIELD OF THE INVENTION

My invention relates generally to a device for disassembling,or "breaking", a roller chain such as a drive chain for bicycles, motor vehicles, motor driven tools, and the like, and more particularly relates to a means for removing pins from a roller chain.

Drive chains are normally used for the transmission of power, and for timing or synchronizing motions. A principal advantage of chain drives is that they provide efficient positive drive and power capacity. Roller chains are particularly efficient and economical at transmitting power because of the ability of the rollers to rotate when contacting sprocket teeth.

The links of sprocket chains, as commonly manufactured, are connected by pins, the connecting pins having a pressed fit in some of the links and a loose fit through the other links so as to give the required flexibility to the chain. In use, it is sometimes necessary to remove these connecting pins for making repairs such as substituting new links for broken ones or for lengthening or shortening the chain.

To be further explained is that a roller chain is comprised of a plurality of cylindrical rollers having bores along their axes, a plurality of inner link plates, a plurality of outer link plates, and a plurality of pins connecting the chain components together. Within the axial bore of each roller is a cylindrical bushing having an outer bearing surface. Each bushing has a narrow bore or pin opening along its cylindrical axis which is in close tolerance with the diameter of a pin. A pin fits tightly within the narrow bore of each bushing so that the pin is immobile with respect to the bushing. The inner surface of the roller slides around the outer surface of the bushing permitting the roller to rotate about the bushing during use. The rollers are arranged colinearly with their axes parallel to one another and perpendicular to the length of the chain. The inner link plates, in combination with the pins, fix the rollers into adjacent pairs which are translationally immobile with respect to one another, while the outer link plates, in combination with the pins, fix the pairs of rollers together and permit the rotation of one pair of rollers with respect to an adjacent pair of rollers. The rollers are spaced apart from one another in the chain to receive the teeth of a sprocket wheel during normal use.

The various components of a roller chain can become damaged or stretched during use, requiring disassembly of the chain, removal or replacement of chain components and reassembly. Because of their design, roller chains cannot be readily repaired with ordinary tools and, consequently, specialized tools for disassembling and reassembling roller chains are a practical necessity.

DESCRIPTION OF THE PRIOR ART

The following patents have been found prior to the filing of the application for this patent and include the following chain "breaker" patents:

U.S. Pat. Nos. 1,994,270 of Mar. 12, 1935 Cetrano 2,332,607 of Oct. 26, 1943 Schroeder et al 2,382,447 of Aug. 14, 1945 Schaeufele There has long been a need for a single device which can "break" chains of different sizes, from small chains, such as bicycle chains, to large chains, such as those used in industrial operations.

To my knowledge, none of the prior art, including the patents cited above, provide such a device.

SUMMARY OF THE INVENTION

The invention hereof provides, in a single device, means for accepting and breaking chains of different sizes, from small chains to large, industrial type chains.

The invention envisions a plurality of drive blocks with outwardly projecting parallel ejection pins of differing sizes and/or spacings to accommodate to chains of different sizes, and a plurality of chain nests of different sizes to accept the ejection pins of a cooperant drive block while holding the chains of a cooperant size, thereby permitting ejection of the roller pins from the chain whereby the chain is "broken" or disassembled.

The interchangeable drive blocks are held by a drive block receiver releasably fixed to a platen or die reciprocated by a ram driven by a pump.

The interchangeable chain nests are held by a chain nest receiver releasably fixed to a stationary platen or die.

The invention provides a tool for use on roller type chain and is designed to simplify the disassembly of roller chains of different sizes by temporarily holding the chain in situ while links or pins are removed.

Stated another way, the invention relates to chain "breakers" or link removers and more particularly it is an object of this invention to provide a chain link remover of the type using a power means for speedy link removal in which the direction of operative movement of the means is toward and at the site of disposition of the chain itself.

The invention has been specially designed for removing the chain pins when it becomes necessary to substitute new links for old ones or to lengthen or shorten the chain.

It is the primary object of the invention to provide a chain disassembly device of the character described that may be power operated as by a pressurized hydraulic cylinder and which is so constructed that the power applied to the operating mechanism will be multiplied when applied to the actual work of forcing the chain pins out of the link bearings.

It is another object of the invention to provide a portable machine that will be instantly available when required.

While the device has been primarily designed for removing sprocket chain pins, it is adaptable for use for analogous purposes.

DESCRIPTION OF THE PREFERRED EMBODIMENTS

Referring now more particularly to the drawings, numeral 10 designates generally the chain breaker or disassembly apparatus of the invention.

Figure 1:
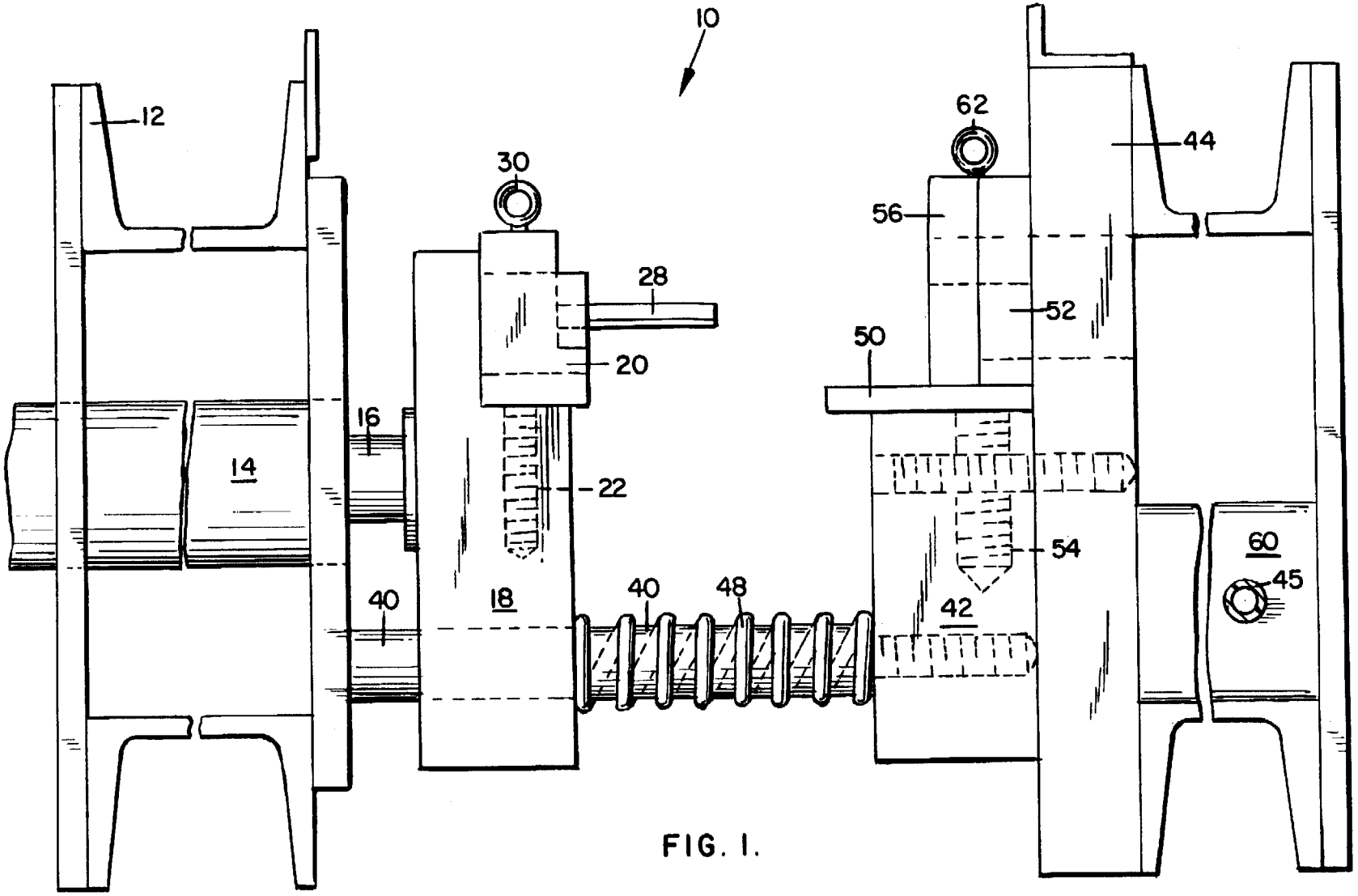
FIG. 1 is a view in side elevation of chain breaker or disassembly apparatus embodying the invention.
Figure 2:
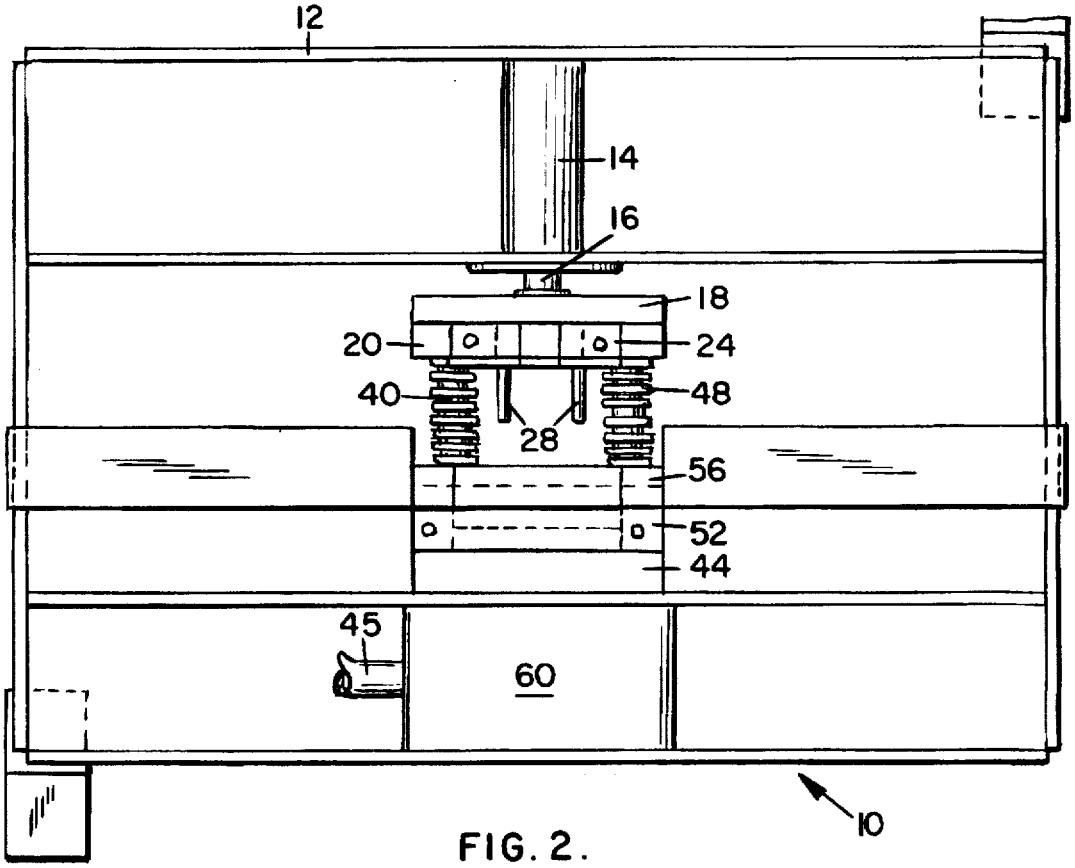
FIG. 2 is a small scale view in top plan of the FIG. 1 apparatus.

In FIG. 1, reading from the leftward or rear side of the machine, I have shown an hydraulic cylinder support 12 which supports an hydraulic cylinder 14 in which a reciprocating ram or piston 16 is movable forwardly and rearwardly as driven by a pump means subsequently to be described.

The outboard end of ram or piston 16 mounts a movable platen or die 18 which is cooperantly movable forwardly and rearwardly with reciprocating piston 16.

Figure 12:
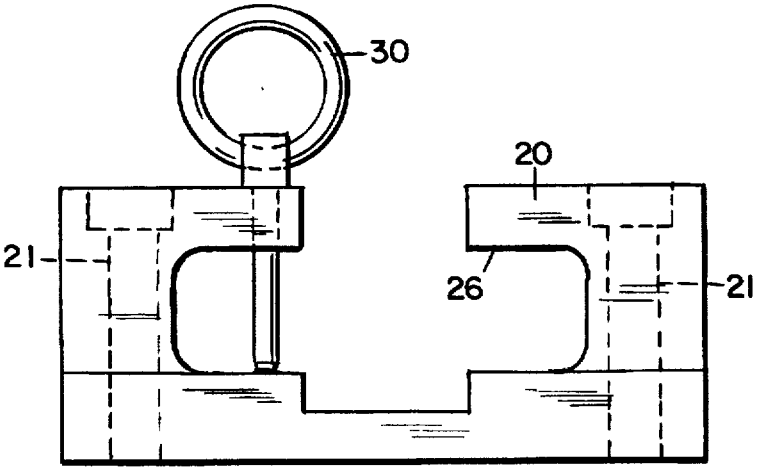
FIG. 12 is a view in front elevation of the drive pin receiver block of the chain breaker of the invention.
Figure 13:
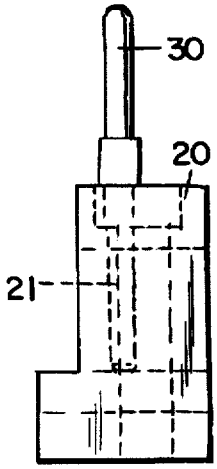
FIG. 13 is a view in end elevation of the drive pin receiver block of FIG. 12.

A drive or ejection block receiver 20, best seen in FIGS. 12 and 13, is mounted on an inset in platen or die 18 and is threadedly engaged with the platen by means of screws 22 which extend through provided openings 21 in receiver 20.

A plurality of drive or ejection blocks 24, of different sizes to accommodate different size chains, only one of which is shown, are provided which are selectively nestable in a nest 26 defined by the drive or ejection block receiver 20.

Ejection blocks 24 are removably secured in nest 26 of ejection block receiver 20 as by a pull pin 30, which extends downwardly through an axially aligned opening in receiver 20 and block 24.

From each of the ejection blocks 24, a pair of spaced, parallel ejection pins 28 project outwardly, the pins being of differing sizes and horizontal spacing for each ejection block to accommodate to differences in chain sizes as will appear.

A pair of spaced, parallel, horizontally disposed slide rods 40 is fixedly mounted at their inboard extremities to hydraulic cylinder support 12, extending through provided openings in movable platen 18 and extending forwardly for threaded engagement with a fixed platen or die 42, which, in turn, is held in threaded securement with a chain support frame 44.

Forwardly of movable platen or die set 18 and rearwardly of fixed platen or die set 42, a spring 48 is sleeved around each slide rod 40.

Spring compression is achieved as ram or piston 16 is reciprocated toward the front of the apparatus.

A chain nest receiver block 52 is mounted upon chain nest support plate 50 fixed to the upper face of fixed platen or die set 42.

A pump 60 is mounted on chain support frame 44 or on the floor or other convenient location and is connected via a connection line 45 to hydraulic cylinder 14.

Chain nest receiver block 52, best seen in FIGS. 8–11, is mounted on support plate 50 by means of screws 54 rearwardly of support frame 44 so as to be in horizontal and vertical alignment with ejection block receiver 20 and drive block 24.

A plurality of chain nests 56 of different sizes to accommodate different size chains, only one of which is shown, are provided which are selectively nestable in a provided opening 58 of chain nest receiver block 52.

Chain nests 56 are removably secured in chain nest receiver block 52 by a pull pin 62 which extends downwardly through an axially aligned opening in receiver block 52 and chain nest 56.

Figure 3:
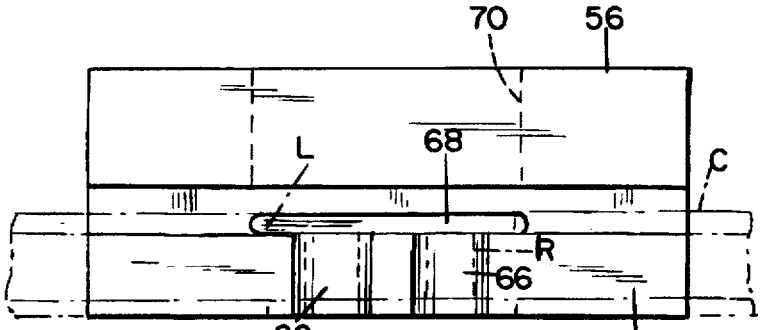
FIG. 3 is a view in top plan of one of the chain nests of the chain breaker of the invention.
Figure 5:
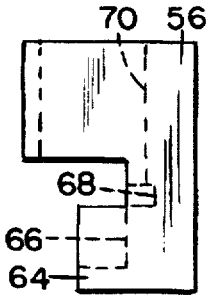
FIG. 5 is a view in end elevation of the chain nest of FIG. 3.
Figure 4:
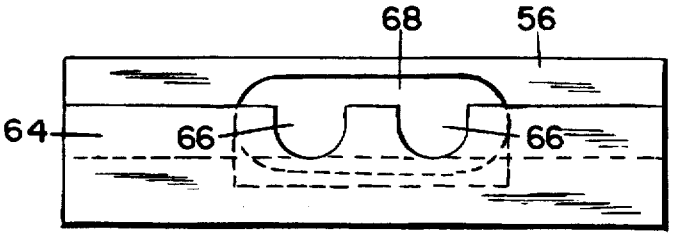
FIG. 4 is a view in front elevation of the chain nest of FIG. 3.
Figure 6:
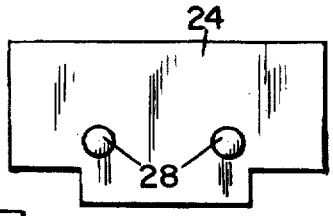
FIG. 6 is a view in front elevation of one of the drive pin blocks of the chain breaker of the invention.
Figure 7:
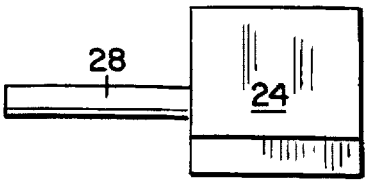
FIG. 7 is a view in end elevation of the drive pin block of FIG. 6.
Figure 8:
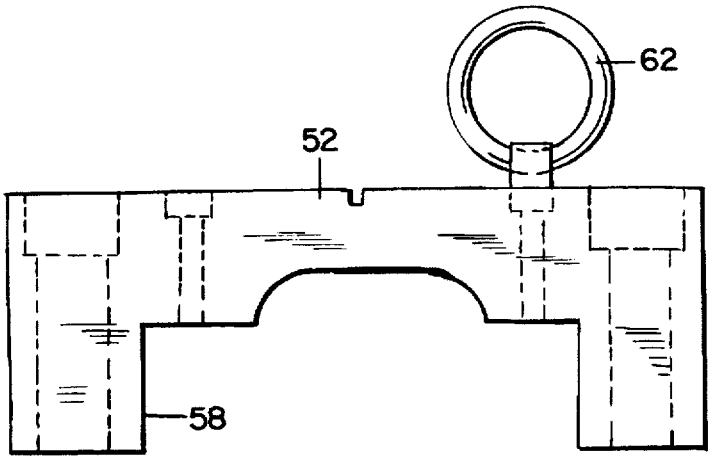
FIG. 8 is a view in front elevation of the chain nest receiver block of the chain breaker of the invention.
Figure 9:
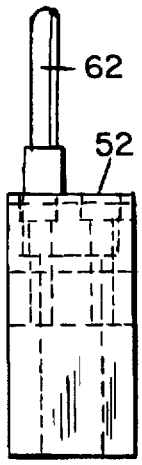
FIG. 9 is a view in end elevation of the chain nest receiver block of FIG. 8.
Figure 10:
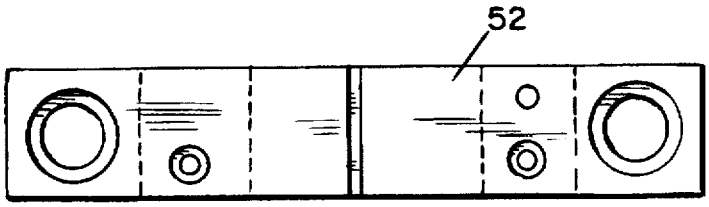
FIG. 10 is a view in top plan of the chain nest receiver block of FIG. 8.
Figure 11:
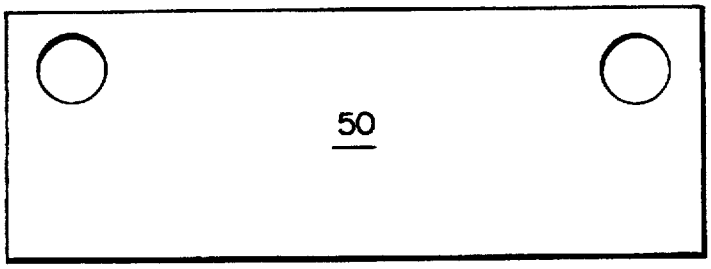
FIG. 11 is a view in top plan of the chain nest support plate of the chain breaker of the invention.

Each chain nest 56 is provided with a shelf or ledge 64 adapted to support a chain C, shown in phantom in FIG. 3, with the shelf or ledge being provided with a pair of spaced grooves 66 for receipt of rollers R of chain C therein.

A clearance relief 68 adjacent grooves 66 provides space for receipt of a link L of chain C.

The rear face of each chain nest 56 is provided with a central entrance opening 70 which provides access into the chain nest.

In use, a chain is placed on ledge 64 of chain nest 56 so chain rollers R are resting in grooves 66, and hydraulic cylinder 14 is actuated by pump 60 to drive movable platen 18 forwardly.

Movable platen 18, which carries drive block receiver 20 and drive block 24 on its forward face, moves along slide rods 40 to move ejection pins 28 of the ejection block to pass through central entrance opening 70 of chain nest 56 into contact with the pins sleeved by rollers R of chain C held by the chain nest to eject the pins from the chain, whereby the chain is "broken" or disassembled.

I claim:

1. A machine for performing work operations in the disassembling of roller chain of varying sizes comprising:

a frame including forward and rearward supporting walls, a piston driving hydraulic cylinder, an hydraulic pump having a fluid connection with the hydraulic cylinder for the driving of the piston, a movable die set mounted on the piston of the hydraulic cylinder and being reciprocable therewith, a stationary die set mounted on the forward supporting wall of the frame, a pair of spaced parallel slide rods mounted on and extending forwardly from the rearward supporting wall of the frame and being extendable through the movable and stationary die sets and secured to the forward supporting wall, a drive pin block receiver mounted on and secured to the movable die set, a drive pin block nestably receivable within the drive pin block receiver, a pair of spaced parallel forwardly facing ejection pins projecting from the respective drive pin block, the drive pin block being one of a plurality of drive pin blocks of differing sizes for accommodating chains of differing sizes, a chain nest receiver block mounted on and secured to the stationary die set, a chain nest receivable within the chain nest receiver block for supporting the to-be-repaired chain, the chain nest being one of a plurality of chain nests of differing sizes for accommodating chains of differing sizes, the chain nest receiving therethrough the ejection pins of a cooperant drive pin block while holding the chain of an accommodated size thereby permitting the ejection of the roller pins from the chain whereby the chain is broken.

2. A machine according to claim 1, wherein the drive pin blocks are releasably secured to the drive pin block receiver by a pull pin.

3. A machine according to claim 1, wherein the chain nests are releasably secured to the chain nest receiver block by a pull pin.

4. A machine according to claim 1, wherein the chain nest is provided with spaced grooves for supporting the chain rollers.

* * * * *